United States Patent [19]

Reding

[11] Patent Number: 4,544,088

[45] Date of Patent: Oct. 1, 1985

[54] CHILD CARRYING HARNESS

[76] Inventor: Nanette L. Reding, 6528 S. Erie, Tulsa, Okla. 74136

[21] Appl. No.: 554,994

[22] Filed: Nov. 25, 1983

[51] Int. Cl.[4] ..... A47D 13/02

[52] U.S. Cl. ..... 224/159; 224/158; D3/31

[58] Field of Search ..... 224/158, 159, 160, 161; D3/31, 32

[56] References Cited

U.S. PATENT DOCUMENTS

| | | | |
|---|---|---|---|
| D. 252,958 | 9/1979 | Tatum | D3/31 |
| D. 253,558 | 12/1979 | Carter | D3/31 |
| 3,197,100 | 7/1965 | Thompson | 224/160 |
| 3,331,540 | 7/1967 | Higuchi | 224/160 |
| 4,428,514 | 1/1984 | Elf | 224/160 X |

*Primary Examiner*—Allan N. Shoap

*Attorney, Agent, or Firm*—Head, Johnson & Stevenson

[57] ABSTRACT

A child carrying or supporting harness for suspending a child from the body of a support person in a safe and comfortable manner and providing freedom for the hands and arms of the support person, the harness comprising a saddle portion for surrounding the "bottom" of the child and strap members extending angularly outwardly from the saddle portion and disposed substantially diagonally with respect to flap members extending angularly outwardly from the opposite side of the saddle member, each of said flap members being provided with clasp or fastening members on the free or outer ends thereof for engagement by a respective strap member. One of the strap members is adapted for encircling the waist of the support person, and the other of the strap members is adapted to encircle the upper torso and neck portion of the support person, with the saddle portion supporting or suspending the child in the proximity of the hip area of the support person.

2 Claims, 3 Drawing Figures

CHILD CARRYING HARNESS

BACKGROUND OF THE INVENTION

1. Field of the Invention

This invention relates to improvements in carrier devices and more particularly, but not by way of limitation, to a child carrying harness.

2. Description of the Prior Art

The transporting of small children or infants by carrying of the child by hand presents many problems for mothers or others, particularly when the child is being carried while the mother is shopping, or is trying to accomplish other deeds or acts. The advantages of carrying of the child by supporting the child from the body of the mother, or other person, in a manner wherein the hands of the mother are free from holding the child have been recognized, and several attempts at providing devices for supporting the child in this manner have been made. For example, the Kehlenbeck U.S. Pat. No. 522,018, issued June 26, 1894, entitled "Baby-Carrier;" Sutter U.S. Pat. No. 781,033, issued Jan. 31, 1905, entitled "Baby Carrier;" Averill U.S. Pat. No. 1,039,009, issued Sept. 17, 1912, entitled "Baby Carrier;" Lippincott U.S. Pat. No. 1,196,003, issued Aug. 29, 1916, entitled "Baby Carrier;" Wood U.S. Pat. No. 2,409,331, issued Oct. 15, 1964, entitled "Baby Carrier;" Thompson U.S. Pat. No. 2,689,672, issued Sept. 21, 1954, entitled "Infant Carrier;" and the Bolton U.S. Pat. No. 3,841,543, issued Oct. 15, 1974, entitled "Infant Carrier." These devices have certain disadvantages, however, in that generally they do not provide sufficient support for the child in order to be safe for the carrying of the child, and the position in which the child must be carried while supported in the device is inconvenient and restrictive for the child itself.

SUMMARY OF THE INVENTION

The present invention contemplates a novel child carrying harness which has been particularly designed and constructed for overcoming the foregoing disadvantages. The novel harness apparatus is of a substantially flat planar overall configuration and comprises a main saddle portion which forms a support or seat for the child. A pair of relatively short straps or flaps extend outwardly from one long side of the saddle portion, and each is provided with a suitable hitch or clasp means. A pair of elongated strap members extend outwardly from the saddle portion in opposite directions with respect to the flaps and each is sufficiently long as to encircle a portion of the body of the person carrying or supporting the child. One of the straps is initially wrapped around the waist of the support person, and the free end of the strap encircling the waist of the support person is then fastened to the clasp means of one of the flap members. The saddle portion is then wrapped around the baby's "bottom" and between its legs. The other strap member is then wrapped around the upper torso portion and neck of the support person, and the free end of the second strap is fastened to the clasp of the other flap member. This results in a suspended harness-type structure which holds the child on a hip of the support person and either hip may be utilized in accordance with the desired position of the support person. The child is supported from the body of the support person in a manner which is both comfortable and safe for the child and support person, and leaves both hands of the support person free for use.

The novel child support or carrying harness is simple and efficient in operation and economical and durable in construction.

Thus, the present invention provides a child carrying harness having a substantially flat planar configuration and comprising:

(a) a saddle portion means operatively adapted for encasing a substantial portion of the posterior of the child to be carried on the hip of another person by passing between the legs of the child, wherein the saddle portion means is characterized, when laid out flat, as having at least four sides from which a pair of strap means extend angularly outwardly therefrom and from which a pair of flap means extend angularly outwardly therefrom;

(b) a first flap means extending angularly outwardly from one side of the saddle portion means and operatively adapted to encircle a portion of the waist of a person carrying the child;

(c) a first strap means extending angularly outwardly from the opposite side of the saddle portion means and substantially in the opposite direction to the first flap means, when laid flat, and operatively adapted for surrounding the waist of a person carrying the child and enageable with the first flap means;

(d) a first fastening means cooperating between the first flap means and the first strap means for securing the first flap means to the first strap means;

(e) a second flap means extending angularly outwardly from another side of the saddle portion means in a direction substantially perpendicular to the direction of the first flap means and first strap means, when laid flat, and operatively adapted to apss between the leg and arm of the child to be carried;

(f) a second strap means extending angularly outwardly from the opposite side of the saddle portion means and substantially in the opposite direction to the second flap means, when laid flat, and operatively adapted for surrounding the upper torso portion of a person carrying the child by passing over the shoulder of the person and engageable with the second flap means; and (g) a second fastening means cooperating between the second flap means and the second strap means for securing the second flap means to the second strap means thus securing the harness to the body of the support person for positioning the saddle portion at the side of the body of the support person for suspending the child in the hip area of the support person and in a manner permitting greater comfort and freedom of movement for the child and reducing obstruction of the front of the support person.

DETAILED DESCRIPTION OF THE PREFERRED EMBODIMENT

Figure 1:
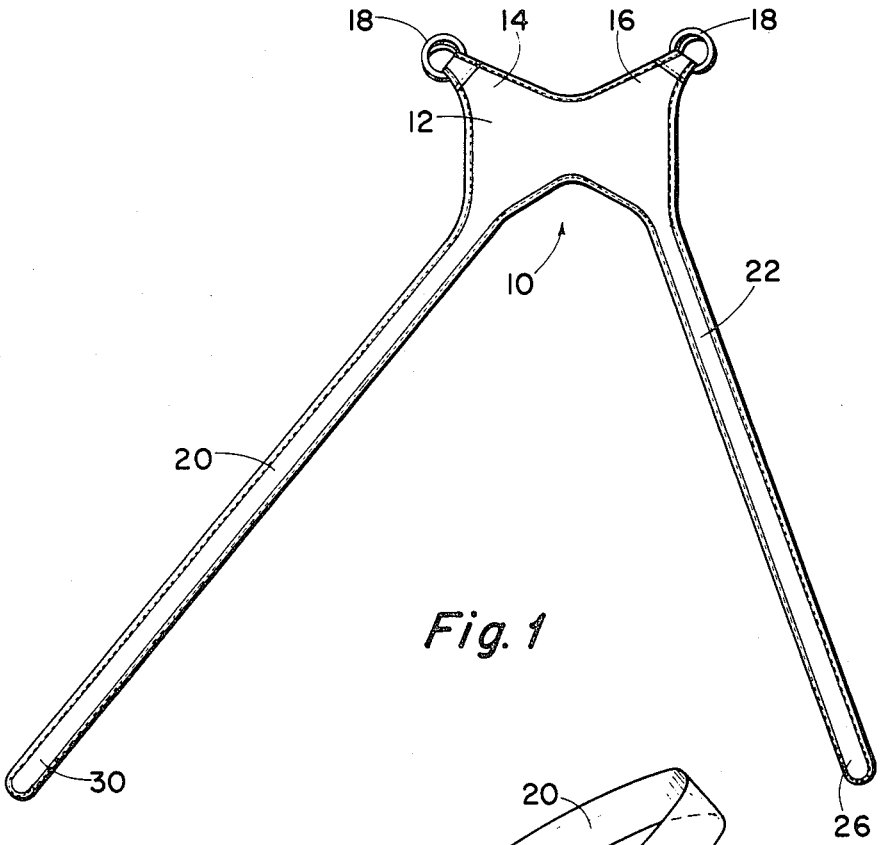
FIG. 1 is a plan view of a child carrying harness embodying the invention.
Figure 2:
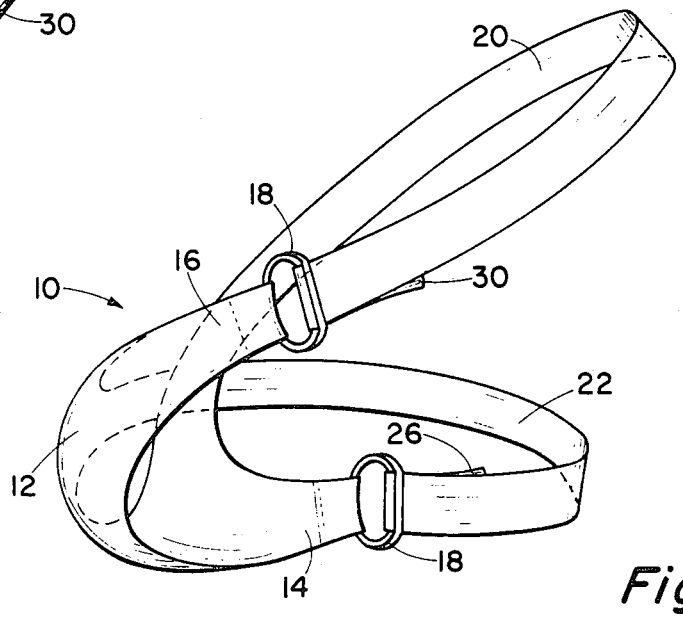
FIG. 2 is a perspective view of a child carrying harness embodying the invention and illustrated in a child supporting mode.

Referring to the drawings in detail, reference character 10 generally indicates a child supporting or carrying harness of a substantially flat planar configuration comprising a main saddle portion 12 of a generally rectangular configuration. A pair of substantially identical relatively short straps or flaps 14 and 16 extend angularly outwardly from the saddle portion 12, as particularly shown in FIG. 1, and are preferably integral therewith, but not limited thereto. A suitable clasp means 18, such as a well known cinch fastener having a pair of Dee rings but not limited thereto, is secured to the outer end of each flap 14 and 16 for a purpose as will be hereinafter set forth.

A first elongated strap member 20 extends angularly outward from the saddle portion 12 and is substantially diagonally disposed with respect to one of the flaps, such as the flap 16. A second elongated strap member 22 extends angularly outward from the saddle portion 12 and is substantially diagonally disposed with respect to the other flap, such as the flap 14. It may be preferable to construct the strap member 20 of greater length than the strap member 22, but there is no intention of limiting the invention thereto.

In use, one of straps, as for example the strap 22, is wound or placed around the waist of the support person 24 for encircling thereof, and the free end 26 of the strap 22 is inserted in and through the cinch fastener 18 of the appropriate flap, such as the flap 14, for securing the device or harness 10 about the waist of the person 24. The saddle portion 12 is then wrapped around the "bottom" of the child 28 being carried or supported by the harness structure 10, and the other strap, such as the strap 20, is then wrapped around the upper torso and neck portion of the person 24, as particularly shown in FIG. 3. The free end 30 of the strap 20 is then inserted in and through the cinch fastener 18 of the appropriate flap, such as the flap 16, and pulled sufficiently tight for affording the desired positioning of the child 28 held or supported by the saddle portion 12. The child is thus suspended from the body of the person 24 in such a manner that it is both secure, and free to view his surrounding rather than having his vision limited directly to and against the body of the person 24. In addition, the child 28 is not only securely supported by the harness apparatus 10, but also there is considerable freedom of air movement about the child's body to reduce discomfort due to overheating while being supported in the harness structure 10.

Figure 3:
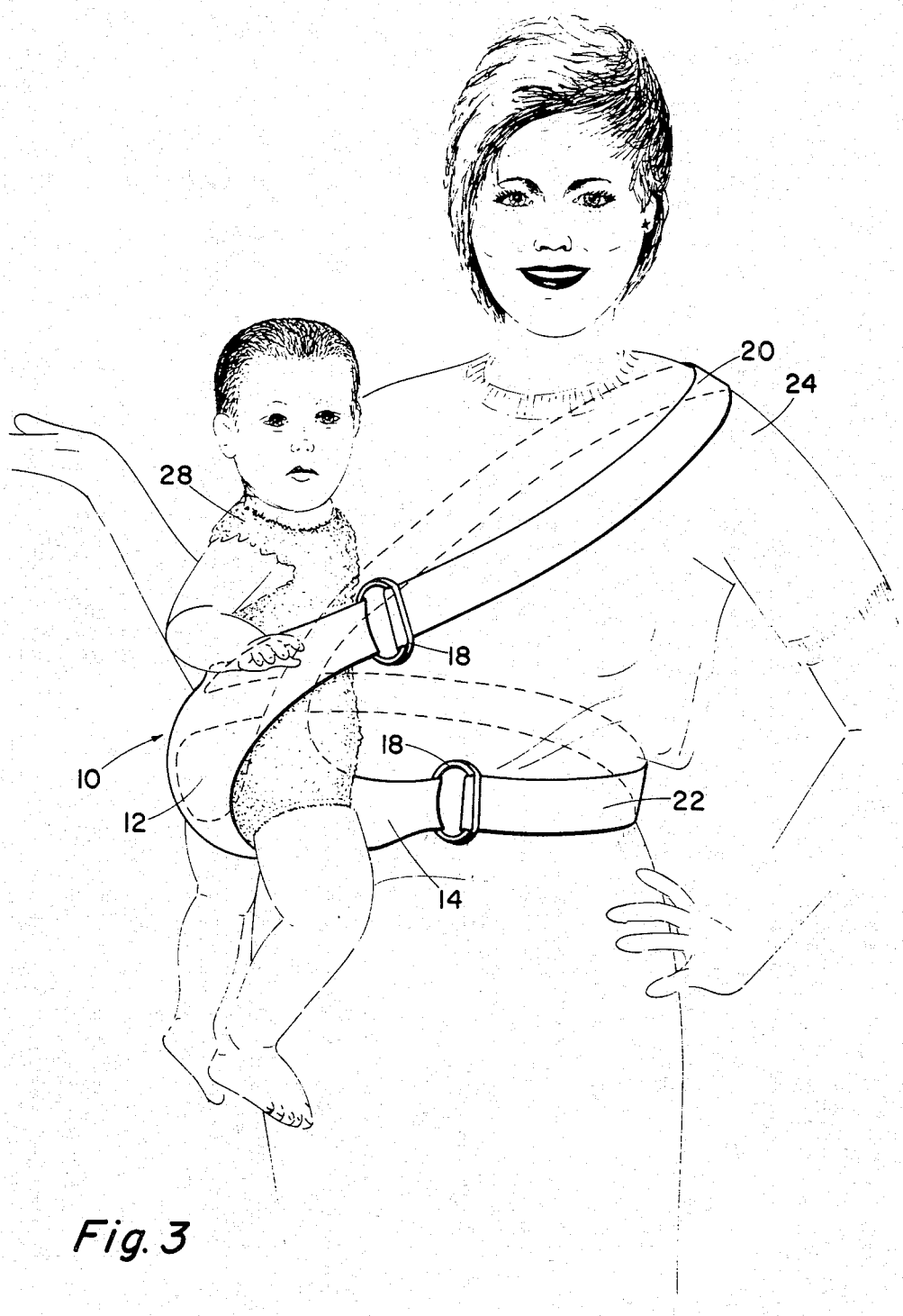
FIG. 3 is a view of a child carrying harness embodying the invention in use for suspending a child from the body of a support person.

It will be readily apparent from an inspection of FIG. 3 that both arms and hands of the person 24 are free, thus providing considerable freedom of movement for the person 24. It will be further apparent that the child 28 is supported by the harness 10 in the proximity of the hip area of the person 24, which is normally a comfortable and secure resting area for both the child 28 and person 24. Of course, the harness 10 may be secured to the person 24 in such a manner that the child 28 may be supported or suspended in the proximity of either the right or left hip area of the person 24, as desired.

When the harness 10 is no longer needed for supporting the child 28, the straps 20 and 22 may be released from the engagement with the respective cinch fasteners 18, whereupon the harness 10 may be removed from its position about the body of the person 24. Of course, the child 28 may be manually supported by the person 24 during the removal of the harness 10, as is well known.

From the foregoing, it will be apparent that the present invention provides a novel carrying or suspension harness apparatus for suspending a child from the body of a support person in such a manner that the child is carried in a safe and comfortable position for both the child and the support person. The harness includes a saddle portion for ease of supporting the child and strap members adapted to encircle both the waist, upper torso and neck portions of the support person whereby the child may be suspended in the proximity of the hip area of the support person for both comfort and safety.

Whereas the present invention has been described in particular relation to the drawings attached hereto, it should be understood that other and further modifications, apart from those shown or suggested herein may be made within the spirit and scope of this invention.

What is claimed is:

1. A child carrying harness having a substantially flat planar configuration and comprising:

(a) a saddle portion means operatively adapted for encasing a substantial portion of the posterior of the child to be carried on the hip of another person by passing between the legs of the child, wherein said saddle portion means is characterized, when laid out flat, as having four sides from which a pair of first and second strap means extend diagonally, angularly outwardly therefrom and from which a pair of first and second flap means extend diagonally, angularly outwardly therefrom, each strap means diagonally opposing a flap means.

(b) said first flap means operatively adapted to encircle a portion of the waist of a person carrying the child;

(c) a first strap means extending substantially in the opposite direction to said first flap means, when laid flat, and operatively adapted for surrounding the waist of a person carrying the child and engageable with said first flap means;

(d) a first fastening means cooperating between said first flap means and said first strap means for securing said first flap means to said first strap means;

(e) said second flap means extending in a direction substantially perpendicular to the direction of said first flap means and first strap means, when laid flat, and operatively adapted to pass between a leg and arm on the same side of the child to be carried;

(f) the second strap means extending substantially in the opposite direction to said flap means, when laid flat, and operatively adapted for surrounding the upper torso portion of a person carrying the child by passing over the shoulder of the person and engageable with said second flap means; and (g) a second fastening means cooperating between said second flap means and said second strap means for securing said second flap means to said second strap means thus securing the harness to the body of the support person for positioning the saddle portion at the side of the body of the support person for suspending the child in the hip area of the support person and in a manner permitting greater comfort and freedom of movement for the child and reducing obstruction of the front of the support person;

said first and second flap means having a first common edge along a first side of said saddle portion means, said first common edge extending in two directions from substantially the center of said first common edge substantially corresponding to the directions said first and second flap means extend, said first and second strap means having a second common edge along a second side of said saddle portion means opposite said first side, said second common edge extending in two directions from substantially the center of said second common edge substantially corresponding to the directions said first and second strap means extend, said first flap means and said second strap means having a third common edge along a third side of said saddle portion means and said second flap means and said first strap means having a fourth common edge along the fourth and remaining side of said saddle portion means, said third and fourth common edges being substantially parallel to each other between their end portions, the centers of said first and second edges being substantially closer together than the centers of said third and fourth edges.

2. A child carrying harness as set forth in claim 6 wherein the fastening means comprises clasp means secured to the outer end of each flap means for receiving the outer end of a respective one of the strap means therein.

* * * * *